United States Patent [19]

Meehan

[11] Patent Number: 4,464,918

[45] Date of Patent: Aug. 14, 1984

[54] METHOD AND APPARATUS FOR AUTOMATIC FEED OF MANDREL TUBE BENDER

[75] Inventor: Ralph J. Meehan, Naperville, Ill.

[73] Assignee: Teledyne Industries, Inc., Aurora, Ill.

[21] Appl. No.: 401,750

[22] Filed: Jul. 26, 1982

[51] Int. Cl.[3] ..... B21D 9/05

[52] U.S. Cl. ..... 72/133; 72/150; 72/307; 414/17; 414/751

[58] Field of Search ..... 72/149, 150, 156, 159, 72/133, 369, 370, 307; 414/17, 18, 751, 753

[56] References Cited

U.S. PATENT DOCUMENTS

| | | | |
|---|---|---|---|
| 2,442,325 | 5/1948 | Kitlica | 72/133 |
| 2,565,971 | 8/1951 | Kitlica | 72/133 |
| 2,979,103 | 4/1961 | Bowman | 72/133 |
| 3,273,364 | 9/1966 | Pohler et al. | 72/133 |
| 3,280,612 | 10/1966 | Schmidt | 72/298 |
| 3,287,952 | 11/1966 | Van Harten | 72/150 |
| 4,311,031 | 1/1982 | Schwarze | 72/133 |
| 4,331,015 | 5/1982 | Benteler et al. | 72/150 |
| 4,331,016 | 5/1982 | Benteler et al. | 72/150 |
| 4,352,615 | 10/1982 | Neukomm | 414/17 |

*Primary Examiner*—E. Michael Combs
*Assistant Examiner*—Charles Rosenberg
*Attorney, Agent, or Firm*—Wood, Dalton, Phillips, Mason & Rowe

[57] ABSTRACT

A method and apparatus for automatic rear loading of mandrel type tube benders. The bender includes a base, bending head at the forward end of the base, carriage for positioning a tube with respect to the bending head, and a mandrel rod supporting on its front end near the bending head a mandrel. The improvement includes the use of two separate clamps for gripping the mandrel rod with respect to the base, one clamp being located near the rear end of the mandrel rod and the other clamp at an intermediate point on the mandrel rod spaced from the first clamp a distance at least equal to the length of the tubes to be bent. The clamps selectively grasp the mandrel rod, at least one clamp grasping the rod at any given time, to allow a tube to be loaded onto the mandrel rod while another tube is being bent.

10 Claims, 6 Drawing Figures

WORKING ZONE
STAGING ZONE
LOADING ZONE

METHOD AND APPARATUS FOR AUTOMATIC FEED OF MANDREL TUBE BENDER

DESCRIPTION

1. Technical Field

This invention relates generally to a tube bender and more particularly to a method and apparatus for automatically feeding a tube bender of the mandrel type.

2. Background Art

Tube benders are well-known in the art and are used to quickly and precisely bend tubes to virtually any desired configuration. When tubes have thin walls, however, there is a danger of buckling the tube during bending, i.e., that the tube walls may not bend uniformly around the desired radius, resulting in the tube deforming and losing its circular cross-section. In order to prevent this, mandrel type benders have been used.

With mandrel type benders, a mandrel is supported at the bending head of the tube bender by a mandrel rod. The mandrel is a cylindrical body with an outer diameter equal to the inner diameter of the tube to be bent. The tube to be bent is fit over the mandrel rod and mandrel with the rearward portion of the rod (i.e., the portion away from the bending head) secured. Thus, when the tube is pulled and bent around the bending head, the mandrel stays stationary and the tube is dragged over it. The mandrel thus helps maintain the circular cross-section of the tube.

Operation of mandrel type benders is such that the mandrel must always be fixed by attaching the mandrel rod to the body of the bender. This feature of mandrel type benders has heretofore hindered the automatic loading of tubes since it has required loading from the front only, front loading having several drawbacks.

A first and major drawback is that front loading of tubes must be sequential. That is, a new tube cannot be loaded until operation on the previous tube is completed and the previous tube removed from the bender. This slows operation and greatly inhibits productivity of the relatively expensive mandrel type benders, causing them to sit virtually idle for a large percentage of the time while being loaded.

Another drawback is that mandrel benders which are automatically loaded from the front must have a long extractor. Conventionally, the mandrel rod is secured with an extractor which will pull back the mandrel rod and mandrel a few inches at the end of the bend in order to free the mandrel, which may have become wedged within the tube during the bend. However, with front loading, the carriage must be used to guide the next tube over the mandrel. This necessitates withdrawing the mandrel back 2–3 feet in order to move it behind the forwardmost position of the carriage.

Still another drawback of front loading is that the loading mechanism, which must be located near the front of the machine, can interfere with the range of operation of the bender by interfering with the tube as it is positioned. This has necessitated making the loading mechanism either movable or locating it off to the side with retractable loading arms, thereby increasing its cost and complexity.

The present invention is directed to overcoming one or more of the problems as set forth above.

DISCLOSURE OF THE INVENTION

In one aspect of the present invention, a mandrel type tube bender is disclosed which permits automatic rear loading of tubes. The bender has a base, bending head at the forward end of the base, carriage for positioning a tube with respect to the bending head, and a mandrel rod supporting on its front end near the bending head a mandrel. The improvement includes the use of two separate clamps for gripping the mandrel rod with respect to the base, one clamp being located near the rear end of the mandrel rod and the other clamp at an intermediate point on the mandrel rod spaced from the first clamp a distance at least equal to the maximum length of the tubes to be bent. The clamps selectively grasp the mandrel rod, at least one clamp grasping the rod at any given time, to allow a tube to be loaded onto the mandrel rod while another tube is being bent.

By permitting rear loading of the tube bender, the productivity of the bender can be maximized. A tube may be positioned for loading prior to the completion of bending of the previous tube and, in fact, may be loaded into the carriage while the last bend is being completed on the previous tube. Further, since loading of the tube does not require a long extraction of the mandrel, the clamp extractor is only required to make a short stroke at the completion of each bend. Still further, since the loading mechanism is at the rear of the bender, it does not interfere in any way with the range of operation of the bender itself.

DESCRIPTION OF THE PREFFERED EMBODIMENT

Figures 1A, 1B, 1C, 2, 3:
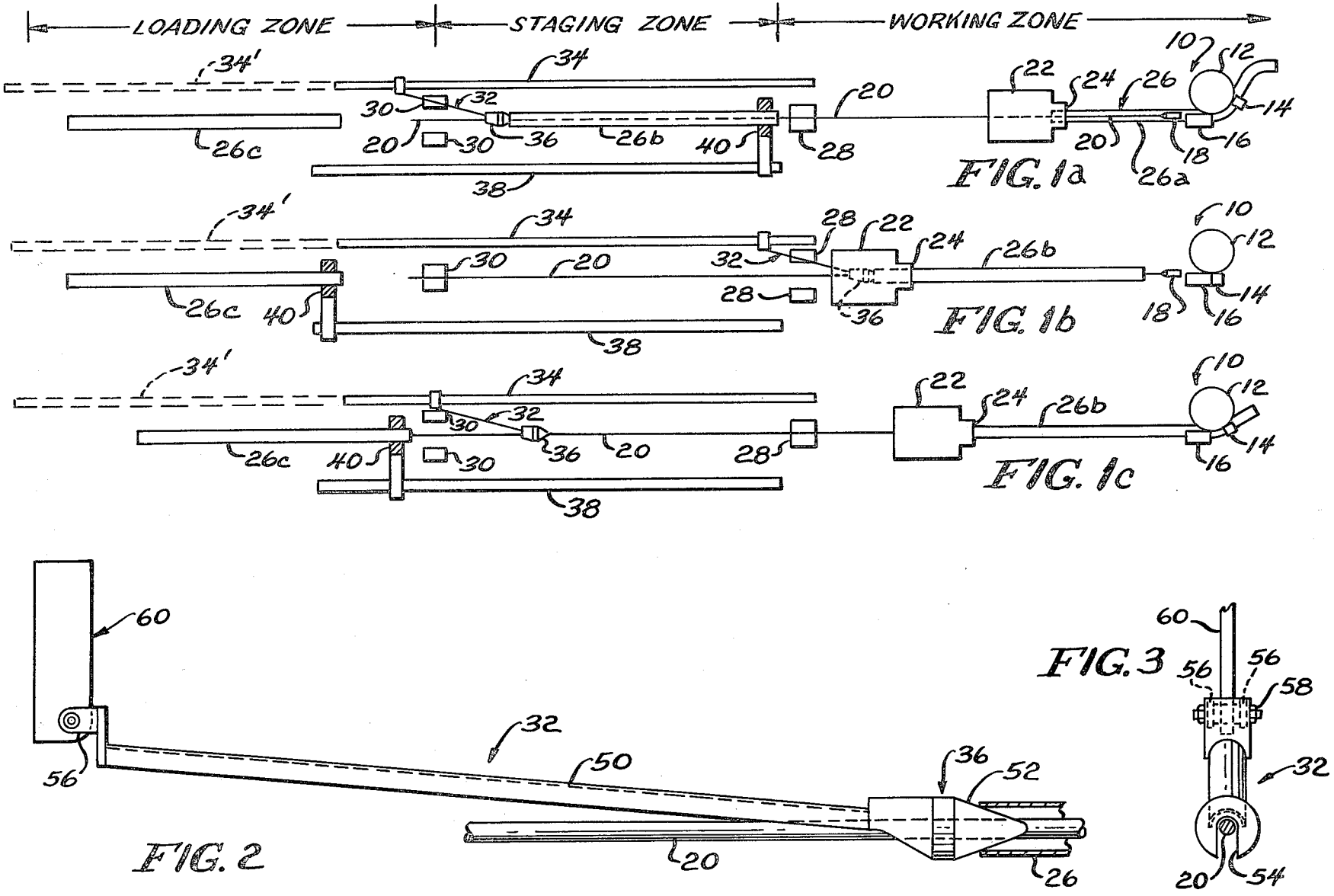
FIGS. 1*a*–1*c* are schematic representations of the operational sequence for rear loading of the mandrel type tube bender.
FIG. 2 is a side view of a pusher rod which may be used with the present invention.
FIG. 3 is an end view of the pusher rod of FIG. 2.

FIGS. 1*a*–1*c* schematically illustrate the method of automatically loading tubes onto a mandrel type tube bender. FIGS. 1*a*–1*c* show a bend head 10 including a bend die 12, pressure die 14 and wiper die 16. These operate in a manner well-known in the art and any bend head usable with a mandrel would be suitable for use with the present invention.

A mandrel 18 is located on the end of a mandrel rod 20 and next to the bend head 10. The mandrel rod 20 extends through a carriage 22 having a collet 24 for grasping a tube 26. The carriage 22 may be of any type suitable for positioning a tube 26 with respect to the bend head 10. Such carriages 22 are well-known in the art.

The novel portions of the apparatus which permit the efficient automatic loading of the tube bender are schematically represented in FIGS. 1*a*–1*c* and also are illustrated and discussed in more detail further below. Shown in FIGS. 1*a*–1*c* are front and rear mandrel rod clamps 28, 30 which may be selectively engaged to hold the mandrel rod 20. A pusher rod 32 is mounted to a cylinder 34 which is substantially parallel to the mandrel rod 20 and which thus will drive the nose 36 of the pusher rod 32 along the mandrel rod 20. A second cylinder 38 is also aligned substantially parallel to the mandrel rod 20 for driving a tube clamp 40 as will be described.

Operationally, the apparatus may be considered to have three zones. At the rear of the apparatus is a loading zone where tubes 26 are aligned and positioned for loading onto the mandrel rod 20. Thus a tube 26c is aligned in this zone with its axis generally the same as the mandrel rod axis.

Preferably, the seam of the tube 26 is also positioned while the tube 26 is in the loading zone. Since the tube seam has a different bending characteristic than the rest of the tube wall, it is important that the seam be located in the same plane with each tube 26 to insure that the tubes are all bent uniformly.

Seam locaters for positioning tubes in this manner are known. One type of seam locater rotates the tube and uses a photoelectric cell to detect the seam (light reflects differently off the seam than it does off the rest of the tube). Teledyne Pines, Inc. of Aurora, Ill. sells a seam locater of this type.

At the front end of the apparatus is a working zone. This zone includes a suitable tube bender having the carriage 22 for positioning a tube 26a with respect to the bend head 10.

Intermediate the load zone and the working zone is the staging zone. After a tube 26c from the loading zone is mounted on the mandrel rod 20, it is held in the staging zone between the mandrel rod clamps 28, 30, staged and awaiting loading into the working zone.

Turning now to the sequence of operation of the apparatus, FIG. 1a may be considered the initial configuration with a tube 26a in the working zone and being operated on by the bend head 10. The mandrel rod 20 is held by the front clamp 28 which retracts the mandrel rod 20 and mandrel 18 at the completion of each bend, as is conventional. A second tube 26b is held in the staging zone. A third tube 26c is in the loading zone.

After the second tube 26b has been moved into the staging zone beyond the rear mandrel rod clamp 30, the rear mandrel rod clamp 30 is engaged to fix the mandrel rod 20 and, once fixed, the front mandrel rod clamp 28 is released. Also, after the pusher rod 32 has engaged the rear of the second tube 26b so as to wedge its nose 36 into the tube 26b as will be described hereafter, the tube clamp 40 is released and moved back to the loading zone.

While the last bend is being made in the first tube 26a, the carriage 22 is retracted to the rear of the working zone (since the tube 26a is released from the carriage 22 during bending). Once the carriage 22 is retracted, the pusher rod 32 is driven forward by its cylinder 34 to move the second tube 26b into the carriage 22 and in the position shown in FIG. 1b. The pusher rod 32 itself is extended into the rear of the carriage 22, permitting the tube 26b to be advanced enough so that the collet 24 grasps the tube 26b at its extreme rear end. This is desirable to simplify bending operations since the carriage 22 need not be retracted between bends on any one tube 26.

When a tube 26b is being moved from the staging zone to the working zone as described above, a tube 26c in the loading zone is positioned and aligned in preparation for moving it into the staging zone. Once properly aligned, it is held in that position by the tube clamp 40 as is also shown in FIG. 1b.

From the position in FIG. 1b, the pusher rod 32 is retracted from the carriage 22 and back to the rear of the staging zone. The carriage 22 may then advance the tube 26b to the bend head 10 for bending operations. The tube 26a which had already been bent may have been removed from the bend head 10 after its final bend, or it can be pushed off by the next tube 26b as that tube 26b is advanced to the bend head 10.

Once the pusher rod 32 has been retracted behind the front mandrel rod clamp 28 the front mandrel rod clamp 28 is engaged to fix the mandrel rod 20 and, once so engaged, the rear mandrel rod clamp 30 is disengaged so that the apparatus is in the position of FIG. 1c. Thereafter, as the bend head 10 continues to bend the tube 26b in the working zone, the tube clamp 40 and third tube 26c may be advanced from the loading zone to the staging zone, thereby putting the apparatus back in the initial position of FIG. 1a.

The overall sequence of operations described above is repeated for bending a series of tubes 26.

In an alternative embodiment, the pusher rod cylinder 34' may be extended back into the loading zone (shown in broken lines in FIGS. 1a–1c) and the tube clamp 40 and its cylinder 38 eliminated. With this embodiment, the pusher rod 32 would thus be used to advance a tube 26 from the loading zone to the staging zone to the working zone.

As can be seen, automatically loading a mandrel type tube bender in this manner maximizes efficiency of operation by enabling operations to be carried out simultaneously, rather than sequentially. The bend head 10 is idle for a minimum amount of time and operations can ideally be carried out as if bending were on one continuous tube, with the carriage 22 being loaded with a new tube 26 and ready for bending operations prior to the completion of bending of a prior tube.

Referring now to details of the structure of the apparatus, the pusher rod 32 is illustrated in FIGS. 2 and 3. The pusher rod 32 includes a rod 50 having at its forward end a bullet-shaped nose 36 with a conical front surface 52. The nose 32 also includes a slot 54 which allows the nose 32 to ride on the mandrel rod 20 such that the central axis of the conical front surface 52 aligns with the central axis of the mandrel rod 20. As a result, when the nose 36 is pushed into the rear of a tube 26 as previously described, it will wedge into a tube 26 of virtually any inner diameter and align the tube axis with the mandrel rod axis. The wedging action also holds the tube 26 in position with its seam properly aligned.

When the pusher rod nose 36 is wedged into a tube 26, it is desirable that the rod 50 be somewhat aligned with the mandrel rod 20 as shown in FIG. 2 so as to permit the pusher rod's extension into the carriage 22 (see FIG. 1b).

Also, as shown in FIG. 2, the pusher rod 32 includes a pair of flanges 56 at its rear which are pivotably connected by suitable means, such as the nut and bolt 58 shown, to a bracket 60 which is driven in a path parallel to the mandrel rod 20 by the first cylinder 34 (not shown in FIGS. 2 and 3). This mounting enables the pusher rod 32 to pivot up and ride over the top of a tube 26 when the tube 26 is advanced from the loading zone to the staging zone as previously decribed. Once the tube 26 has passed beneath it, the pusher rod 32 will drop back down with the mandrel rod 20 in the nose slot 54 as illustrated in FIGS. 2 and 3 so that the pusher rod 32 may then be advanced to wedge into the rear of that tube 26b.

Figure 4:
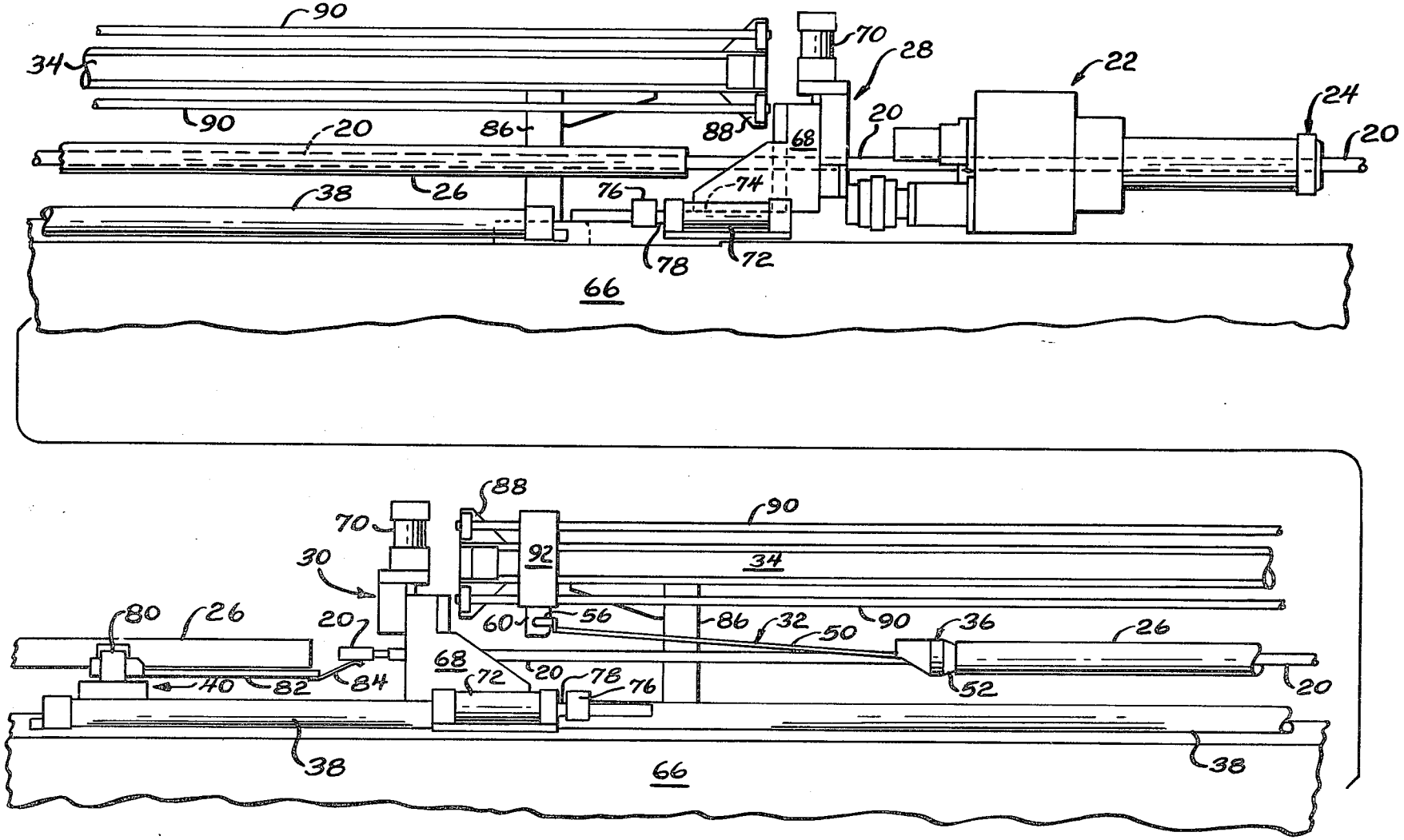
FIG. 4 is a fragmentary side view of the staging zone of the apparatus.

Details of the staging zone are illustrated in FIG. 4. The loading and working zones are, as previously described, known in the art (e.g. seam locators and bending heads) and thus are not shown in detail here.

A base 66 supports the entire apparatus. At the right end of FIG. 4 (the rear end of the working zone) is the carriage 22 and collet 24. Extending through the carriage 22 and to the rear of the staging zone is the mandrel rod 20. The mandrel rod 20 is supported in the staging zone by the front and rear mandrel rod clamps 28, 30 (generally by one or the other, depending on which is engaged as previously described).

Each of the mandrel rod clamps 28, 30 include a clamping structure 68 which has any suitable means for securely grasping the mandrel rod 20, such as a pair of concave clamping jaws (not shown). Supported by the clamping structure 68 is a clamping cylinder 70 which may be actuated to pressure the clamping jaws together to grasp the mandrel rod 20 or may be actuated to retract the clamping jaws clear of the mandrel rod 20 to allow a tube 26 to be slid over the mandrel rod 20 and past the clamp 28,30.

A pair of extractor cylinders 72 are also provided with each mandrel rod clamp 28,30 to pull back the mandrel rod 20 in order to extract the mandrel 18 from the area of the bend head 10 at the completion of a bend (as is conventional). The pair of extractor cylinders 72 are fixed to the base 66 on opposite sides of a longitudinally disposed track 74 on the base 66. The clamping structure 68 is movable along the track 74 and is connected to a transverse bar 76 which is fixed at both ends to the piston rods 78 of the respective extractor cylinders 72. Thus, the pair of extractor cylinders 72 act in concert to move the transverse bar 76 and clamping structure 68 longitudinally in order to extract the mandrel 18.

In order to provide maximum efficiency of operation, both the front and rear mandrel rod clamps 28,30 should be provided with extractor cylinders 72. However, if desired, only the front mandrel rod clamp 28 need be provided with extractor cylinders 72. The efficiency of the apparatus would not be reduced significantly if the rear mandrel rod clamp were not provided with extractor cylinders 72 since the rear mandrel rod clamp 30 is not generally used to extract the mandrel 18.

Extending along the base 66 from the front portion of the loading zone to the front of the staging zone is the cylinder 38 for driving the tube clamp 40 for moving tubes 26 from the loading zone to the staging zone as previously described. Any means for driving the tube clamp 40 parallel to the mandrel rod 20 would be suitable but the preferred structure is a rodless pneumatic cylinder 38 in which the tube clamp 40 is connected to the piston (not visible) through the side of the cylinder 38. Such cylinders are available in the market, as from Origa Corporation of Elmhurst, Ill.

The tube clamp 40 includes clamping jaws 80 capable of grasping tubes 26 of different diameters. Also, carried by and extending forwardly from the tube clamp 40 is a support member 82 having a mandrel rod support 84 on its forward end. The mandrel rod support 84 thus slides along the mandrel rod 20 when the tube clamp 40 is moved. The mandrel rod support 84 is provided to hold up the mandrel rod 20 since the end of the mandrel rod 20 has a tendency to hang down when not supported (as when the clamping jaws of the rear mandrel rod clamp 30 are retracted). Thus, the mandrel rod support 84 ensures that a tube 26 when moved into the staging zone from the loading zone will slide over the mandrel rod 20 without ramming against the mandrel rod 20 or missing it entirely.

The cylinder 34 for the pusher rod 32 is supported above the mandrel rod 20 by suitable means such as support columns 86 fixed to the base 66. Again, any means for driving the pusher rod 32 in a path parallel to the mandrel rod 20 would be suitable, but the preferred structure is a rodless pneumatic cylinder 34.

End support plates 88 are fixed to both ends of the cylinder 34 to support a pair of track rods 90 which are parallel to the cylinder 34 and support a driven member 92. The driven member 92 is fixed to the piston (not shown) of the rodless cylinder 34 and slides on the track rods 90 in a path parallel to the mandrel rod 20. The pusher rod bracket 60 is fixed to the driven member 92 so that the pusher rod 32 is driven along the mandrel rod 20 as previously described.

Other aspects, objects and advantages of this invention can be obtained from a study of the drawings, the disclosure and the appended claims.

I claim:

1. In a mandrel type tube bender having a base, bending head, carriage for positioning a tube and its seam with respect to said bending head, and a mandrel rod supporting on its front end near said bending head a mandrel, the improvement comprising:

first means for selectively fixing the rear of said mandrel rod with respect to said base;

second means for selectively fixing an intermediate portion of said mandrel rod with respect to said base, wherein said one of said fixing means may be released when the other is engaged, thereby permitting loading of a tube over the rear of said mandrel rod and between said second means and said bending head;

means for securing a tube and its seam with respect to said base, said securing means being movable along a path substantially parallel to said mandrel rod to move a tube secured thereby over said mandrel rod and between said first and seconds means; and means for advancing the tube with its seam in the same position with respect to the base as when the tube is engaged by the securing means, said means advancing the tube past the second means and substantially through the carriage whereby the carriage may grasp the tube at its rear end.

2. The improvement of claim 1, further comprising means for moving said second fixing means rearwardly when said second fixing means is engaged.

3. The improvement of claim 2, further comprising a support member carried with said securing means and sliding under said mandrel rod to support said mandrel rod.

4. The improvement of claim 1, wherein said advancing means comprises a pusher rod having a bullet nose for wedging into the rear end of said tube, said nose including a slot therein enabling the nose to ride on the mandrel rod with the mandrel rod at the center of the nose.

5. The improvement of claim 4, wherein the pusher rod also is the securing means.

6. The improvement of claim 4, wherein the securing means is a clamp driven parallel to the mandrel rod and the pusher rod is pivotable whereby as a tube secured by the clamp moves past the bullet nose, the nose is lifted from the mandrel rod.

7. A mandrel type tube bender having a loading zone, a staging zone, and a working zone including a carriage and bending head, said tube bender further comprising:

a mandrel rod associated with said staging and working zones and extending through said carriage;

a mandrel on one end of said mandrel rod near said bending head;

first and second means at opposite ends of said staging zone for selectively fixing said mandrel rod to said staging zone at respectively the second end of the mandrel rod adjacent said loading zone and an intermediate point of said mandrel rod adjacent said working zone;

means for moving a tube with its seam aligned from said loading zone to said staging zone and over said mandrel rod when said first fixing means is disengaged; and a pusher rod riding on said mandrel rod for moving a tube from said staging zone to said working zone and into engagement with said carriage when said second fixing means is disengaged, said pusher rod having a conical front surface for wedging into the rear end of said tube to maintain the tube seam in alignment.

8. The tube bender of claim 7, further comprising a pivotal mounting for said pusher rod permitting said pusher rod to be cleared from said mandrel rod.

9. The tube bender of claim 8 wherein said moving means comprises a clamp and means for driving said clamp in a path between said staging and said working zones, said path being substantially parallel to said mandrel rod.

10. The tube bender of claim 7, wherein said pusher rod is extendable into said carriage.

* * * * *